US006827516B2

(12) United States Patent
Gutberlet

(10) Patent No.: US 6,827,516 B2
(45) Date of Patent: Dec. 7, 2004

(54) COSMETIC UNIT

(75) Inventor: Detlev Gutberlet, Altdorf (DE)

(73) Assignee: h&m gutberlet GmbH, Nurnberg (DE)

( * ) Notice: Subject to any disclaimer, the term of this patent is extended or adjusted under 35 U.S.C. 154(b) by 0 days.

(21) Appl. No.: 10/393,935

(22) Filed: Mar. 24, 2003

(65) Prior Publication Data

US 2003/0180082 A1 Sep. 25, 2003

(30) Foreign Application Priority Data

Mar. 23, 2002 (DE) ..... 202 04 670 U

(51) Int. Cl.[7] ..... B43K 29/00

(52) U.S. Cl. ..... 401/25; 481/17; 481/19; 481/29; 481/34; 481/54; 481/75

(58) Field of Search ..... 401/17, 19, 23, 401/25, 29, 34, 52, 54, 68, 75, 118, 195

(56) References Cited

U.S. PATENT DOCUMENTS 5,056,179 A * 10/1991 Capponi ..... 15/105
6,543,458 B1 * 4/2003 Ohba ..... 132/218

* cited by examiner

*Primary Examiner*—Gregory L. Huson
*Assistant Examiner*—Peter deVoRe
(74) *Attorney, Agent, or Firm*—Browdy and Neimark, P.L.L.C.

(57) ABSTRACT

In a cosmetic unit comprising two different cosmetic products and two different applicators, provision is made, with a view to cost-saving manufacture based on a minimum of components and simplicity of assembly, for a central sleeve; a threaded plug which is fixable in the central sleeve; a threaded spindle which reaches through a hole, with a female thread, of the threaded plug and on the outer end of which is provided a cup that houses a cartridge, the cup being mounted, via axial projections, non-rotatably, but axially displaceably in a protective guide section; an insert which is plugged into the central sleeve in the vicinity of the threaded spindle and which includes the protective guide section that is formed outside the central sleeve; an applicator handle which adjoins the inside end of the threaded spindle; and a helical spring which extends between the threaded plug and the inner front end of the applicator handle, forcing the applicator outwards against a cosmetic compound contained in the screw cap which is screwed on the central sleeve.

3 Claims, 3 Drawing Sheets

COSMETIC UNIT

BACKGROUND OF THE INVENTION

1. Field of the Invention

The invention relates to a cosmetic unit comprising two different cosmetic products and two different applicators.

2. Background Art

A cosmetic unit or cosmetic pencil of the generic type is known from DEU-94 18 823 specifying a cosmetic pencil of a design such that an applicator is spring-loaded and dips into a cosmetic compound when a cap-type housing member that is filled with the cosmetic compound is screwed on or off.

DE 101 11 570 teaches a cosmetic pen which includes a rotary type pusher mechanism, offering a wide range of use.

Furthermore, there are numerous familiar prior art solutions, combining two different types of applicators in a single utensil; these familiar products either are very complicated to manufacture or unsatisfactory in use.

SUMMARY OF THE INVENTION

It is an object of the invention to embody a cosmetic unit of the type mentioned at the outset in such a way that cost-saving manufacture is ensured by a minimum of components and simplicity of assembly, it being desirable for the combined appliances to be purchased, selected, handled and refilled separately.

According to the invention, this object is attained in a cosmetic unit comprising a central sleeve; a threaded plug which is fixable in the central sleeve; a threaded spindle which reaches through a hole, with a female thread, of the threaded plug and on the outer end of which provision is made for a cup that houses a cartridge, the cup being mounted, via axial projections, non-rotatably, but axially displaceably in a protective guide section; an insert which is plugged into the central sleeve in the vicinity of the threaded spindle and which includes the protective guide section that is formed outside the central sleeve; an applicator handle which adjoins the inside end of the threaded spindle; and a helical spring which extends between the threaded plug and the inner front end of the applicator handle, forcing the applicator outwards against a cosmetic compound contained in the screw cap which is screwed on the central sleeve.

The above-specified design according to the invention requires comparatively few components and ensures simplicity of assembly.

In particular, it offers a multiplicity of combinations of varying cosmetic utensils with varying applicators and/or varying cosmetic compounds, it being conceivable, proceeding from identical basic components, to have units of double function as well as separate single-function units.

If for instance the insert for cartridge advance that is plugged into the central sleeve is removed from where it is locked into place, a simple cover sleeve can be placed on instead of the central sleeve, offering a high-quality lipstick and cartridge advance in working order.

The released end of the rest of the central sleeve with screw cap and the cosmetics contained therein, for instance an eye cosmetic compound, can easily be equipped with a cap instead of the lipstick so that the device for eye-cosmetic application may as well be used independently.

From a viewpoint of manufacture, it is conceivable to have two entirely different cosmetic appliances produced, including different applicators and varying cosmetics, possibly by different manufacturers, and to offer them separately to customers in a store so that customers may select the parts corresponding to their specific requirements and combine them in the form of a twin unit for use in practice. As compared to familiar prior art solutions, this offers surprising and extraordinarily advantageous combinations to the manufacturer as well as to the consumer.

In keeping with another embodiment of the invention, provision can be made for the helical spring to support itself, by its inner end, on an insert that is axially fixed by arresting beads. This feature too helps obtain a cosmetic device, including a helical spring, which can be manufactured, offered and used independently.

The same applies to the feature according to which the threaded plug is axially fixed by arresting beads and corresponding annular grooves. If, for dismantling, traction is exercised on the insert that is insertable into the central sleeve, the threaded plug is extracted axially by interaction through the threaded spindle and can be inserted in a separate sleeve with corresponding annular locking recesses instead of being placed in the central sleeve of the combined appliance.

The insert is rotatably mounted in the central sleeve for advance and retraction of a cartridge that is arranged in the mentioned cup, i.e., it is axially locked into place, but its movability in the peripheral direction is maintained.

Details of the invention will become apparent from ensuing description of a preferred exemplary embodiment, taken in conjunction with the drawing.

BRIEF DESCRIPTION OF THE DRAWING

FIG. 5 is a sectional view of a cosmetic unit according to the invention, with a screw cap placed on.

DESCRIPTION OF THE PREFERRED EMBODIMENT

Figure 1:
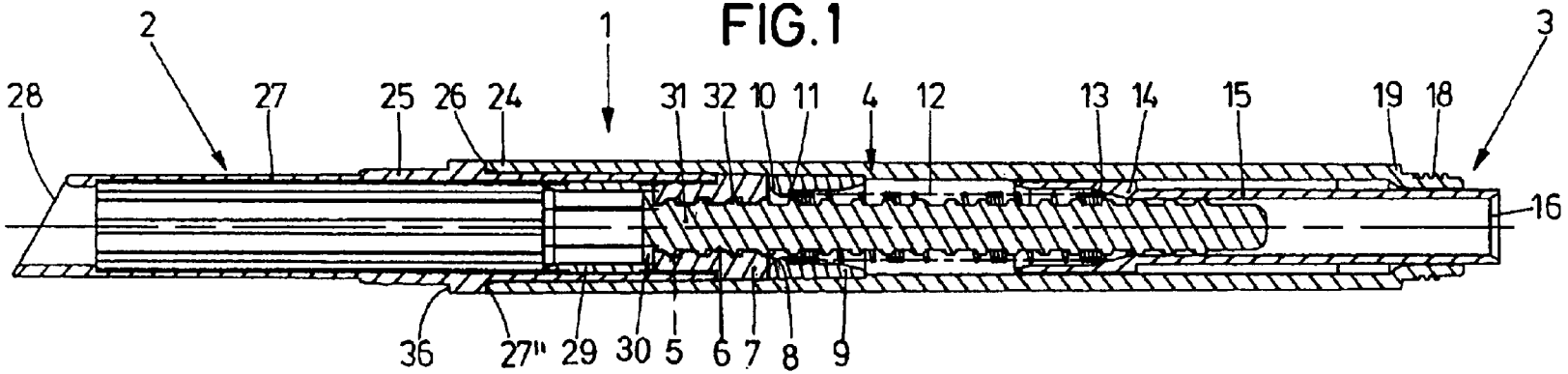
FIG. 1 is a longitudinal sectional view of the cosmetic unit according to the invention.

A cosmetic unit 1 seen in the drawing is designed to comprise two separate cosmetic appliances 2, 3 for individual and independent handling, selection and refilling. These cosmetic appliances may be lipsticks, pens for flat or linear eye cosmetic application or the like.

The exemplary embodiment provides a first cosmetic appliance 2 which is a lipstick applicator with a screw-out-type cartridge and a second cosmetic appliance 3 which is a spring-loaded applicator 17 for flat eye cosmetic application.

The cosmetic unit according to the invention includes a central sleeve 4, in the central area of which a threaded plug 7 is non-rotatably fixed and axially clamped; the plug 7 has a central hole 6 with an internal thread 5.

Figure 2:
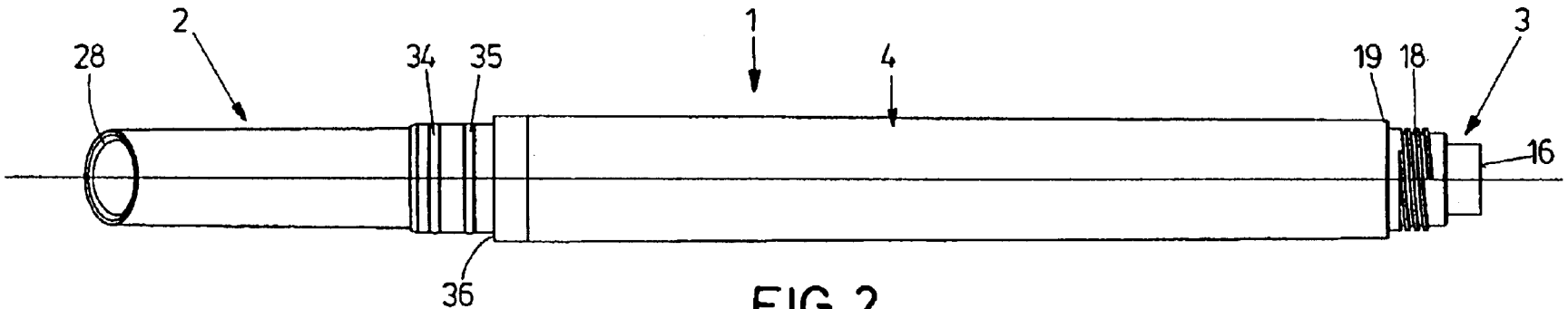
FIG. 2 is a side view of the cosmetic unit according to the invention.

The inner front end 8 of the threaded plug 7 is adjoined by an axially fixed insert 9 which has an annular bead 10 that projects inwardly, forming an annular collar 11 which serves as a stop for a compressible helical spring 12 which bears against the front end 13 of the fat end 14 of an applicator handle 15; a synthetic foam applicator 17 (not shown in FIGS. 1 and 2) is insertable into the frontal aperture 16 at the other end of the handle 15.

A cap 20 is screwed, via an internal thread 21, on an external thread 18 on the end 19 of the central sleeve 4, holding a supply of a cosmetic compound 22, so that the helical spring 12 presses the applicator 17 against the surface 23 of this compound 22, which is scraped off the applicator 17 when the cap 20 is unscrewed and which can then be applied.

At the opposite end 24 of the central sleeve 4, an insert 25 is rotatably placed in the sleeve 4, bearing by an annular collar 26 against the front end 27' thereof. The insert 25 comprises a cylindrical protective guide section 27 with an inclined outlet 28 for a lipstick cartridge (not shown), the inner end of which, in a manner known per se, lodges in a cup 29; a threaded spindle 31 is fixed on and extends away from the bottom 30 of the cup 29, its external thread 32 engaging with the internal thread 5 of the threaded plug 6 that is fixed in the central sleeve 4.

A cap 33 can be placed on the cylindrical protective guide section 27, locking into place on two encircling locking beads 34, 35 and resting axially on an annular shoulder 36 of the insert 25.

By way of axial projections (not shown), the cup 29 is fixed non-rotatably, but axially displaceably in the cylindrical protective guide section 27 so that, upon rotation of the cylindrical protective guide section 27, the cup 29 and the cartridge contained therein are moved for practical use towards the outlet 28 by the advance motion of the threaded spindle 31 inside the threaded plug 7.

In spite of the versitility of combination and use, a cosmetic unit according to the invention can be made from very few components and easily assembled.

Figure 4:
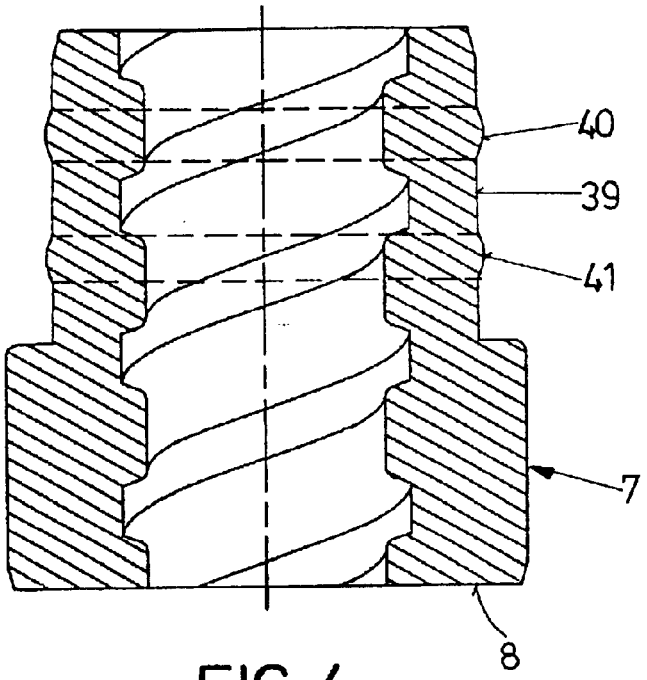
FIG. 4 is a longitudinal sectional view, on an enlarged scale, of the threaded plug.
Figure 3:
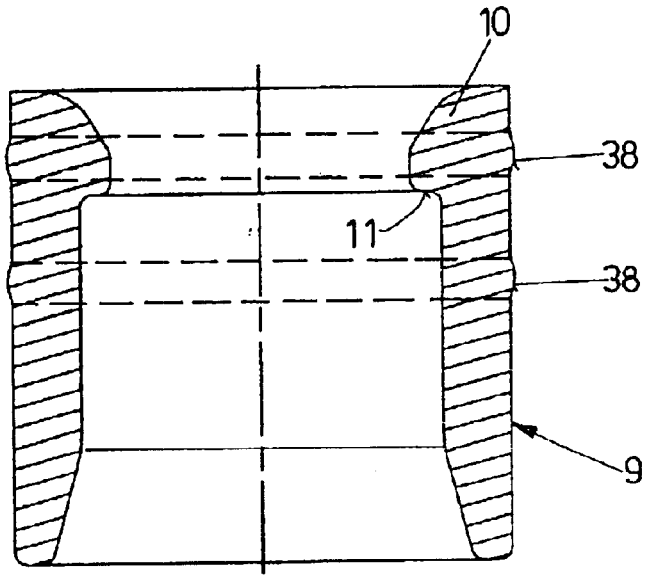
FIG. 3 is a sectional view, on an enlarged scale, of the insert that serves as a stop for the helical spring.
Figure 5:
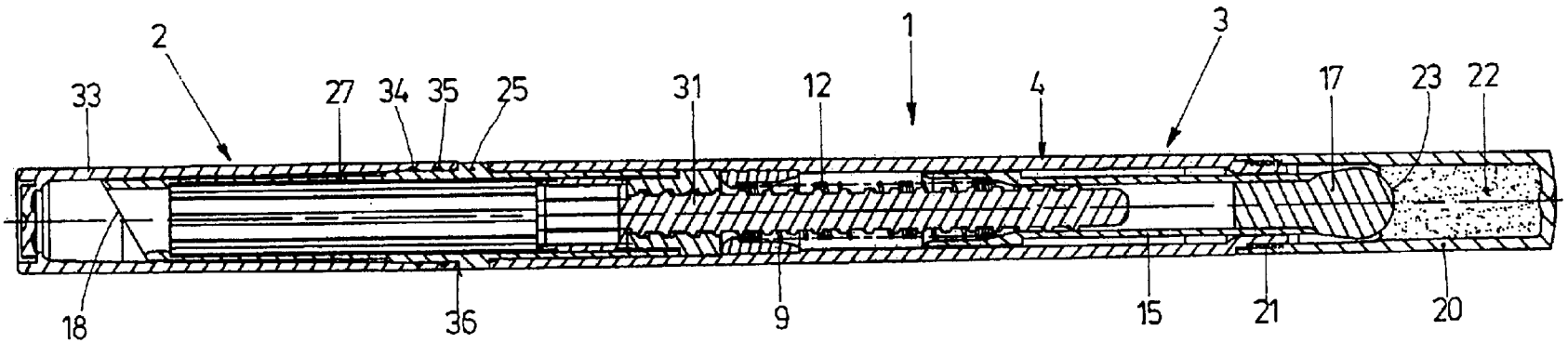

The threaded plug 7 is axially fixed in insert 25 by arresting beads 40, 41 (seen in FIG. 4) which are formed on the tapered section 39 thereof and engage with corresponding annular grooves.

When the above-mentioned components are assembled, the handle 15 is pushed into the central sleeve 4, after which are inserted the helical spring 12, the insert 9 and subsequently the threaded plug 7 and then the insert 25, the cylindrical protective guide section 27 being placed in afterwards.

The above explanation clearly shows that, proceeding from one and the same basic construction, entirely different cosmetic appliances 2, 3 may be used, it being in particular possible to arrange an applicator or a cartridge for extension and retraction by a spindle mechanism. Assembly can take place easily and rapidly without any tools.

What is claimed is:

1. A cosmetic unit comprising a central sleeve (4);

a threaded plug (7), which is fixable in the central sleeve;

a threaded spindle (31), which extends through a hole, with a female thread (5), of the threaded plug (7), and on an outer end of which a cup (29) is fixed that houses a cartridge, the cup (29) being mounted non-rotatably, but axially displaceably in a protective guide section (27);

a first insert (25), which is plugged into the central sleeve (4) in the vicinity of a threaded spindle (31) and which includes the protective guide section (27) that is formed outside the central sleeve (4);

an applicator handle (15), which adjoins an inside end of the threaded spindle (31); and a helical spring (12), which extends between the threaded plug (7) and the inner front end of the applicator handle (15), forcing the applicator handle (15) outwards against a cosmetic compound (22) contained in a screw cap (20), which is screwed on the central sleeve (4)

wherein the first insert (25) is rotatably mounted in the central sleeve (4) for extending and retracting a cartridge that is disposed in the cup (29).

2. A cosmetic unit according to claim 1, wherein the helical spring (12) supports itself by an inner end on a second insert (9) which is axially fixed by arresting beads (38).

3. A cosmetic unit according to claim 1, wherein the threaded plug (7) is axially fixed by arresting beads (40, 41) and corresponding annular grooves in the first insert (25).

* * * * *